US007002593B2

(12) United States Patent
Milch et al.

(10) Patent No.: US 7,002,593 B2
(45) Date of Patent: Feb. 21, 2006

(54) METHOD FOR REDUCING THE POWER USED BY EMISSIVE DISPLAY DEVICES

(75) Inventors: James R. Milch, Penfield, NY (US); Ronald S. Cok, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 558 days.

(21) Appl. No.: 10/003,840

(22) Filed: Nov. 1, 2001

(65) Prior Publication Data

US 2003/0080967 A1 May 1, 2003

(51) Int. Cl.
*G09G 5/00* (2006.01)

(52) U.S. Cl. ..... 345/589; 345/211; 715/524

(58) Field of Classification Search ..... 345/211, 345/589, 698; 715/504, 513, 522–524
See application file for complete search history.

(56) References Cited

U.S. PATENT DOCUMENTS 5,248,963 A * 9/1993 Yasui et al. ..... 345/98
5,598,565 A * 1/1997 Reinhardt ..... 713/323
6,023,714 A * 2/2000 Hill et al. ..... 715/513
6,160,541 A * 12/2000 Palalau et al. ..... 345/211
6,313,878 B1 * 11/2001 Jankowiak ..... 348/377
6,320,587 B1 * 11/2001 Funyu ..... 345/467
6,452,582 B1 * 9/2002 Rolston ..... 345/102
6,535,985 B1 * 3/2003 Oshima et al. ..... 713/323
2001/0012005 A1 * 8/2001 Choi ..... 345/211
2002/0018060 A1 * 2/2002 Yamazaki et al. ..... 345/211
2002/0196257 A1 * 12/2002 Paolini et al. ..... 345/467

* cited by examiner

*Primary Examiner*—Kee M. Tung
*Assistant Examiner*—Wesner Sajous
(74) *Attorney, Agent, or Firm*—Andrew J. Anderson; Thomas H. Close

(57) ABSTRACT

A method for reducing the power used by a display device having light emitting pixels, includes the steps of: receiving formatted information for presentation on the display device; modifying the format of the formatted information to reduce the number and/or intensity of bright pixels in a display of the formatted information; rendering the modified formatted information; and displaying the rendered modified formatted information on the display device.

44 Claims, 2 Drawing Sheets

METHOD FOR REDUCING THE POWER USED BY EMISSIVE DISPLAY DEVICES

FIELD OF THE INVENTION

The present invention relates to portable display devices presenting formatted information content to users and, in particular, to reducing the power used by such display devices.

BACKGROUND OF THE INVENTION

Portable electronic devices are used for many applications. Examples include telephones, personal digital assistants (PDAs), pagers, global positioning systems, digital cameras, and the like. Many of these devices rely on a local power supply with a very limited lifetime. Moreover, many of these devices include a display used to present text, graphics, and images to users.

Displays in common use for mobile devices are primarily based on liquid crystal displays (LCD). Reflective LCD displays take very little power to operate but cannot be seen in the dark, i.e. they require external illumination. Transmissive LCD displays utilize a back-light to provide illumination that is blocked (or not) by pixel elements in a display. The back-light illumination is used regardless of the display content. For example, displaying a black screen requires the same amount of power as displaying a white or colored screen. In contrast, emissive displays, such as organic light emitting diode (OLED) displays, only use power when emitting light so that displaying a black screen requires no power while displaying a white or colored screen does require power.

Most information presented on displays is formatted by a mark-up language compatible with the standard generalized markup language (SGML) specification. Such a language typically specifies the size, font, background, position, etc., of text as well as the location and size of graphic or image elements in the information. A mark-up language provides instructions to a computer controlling the display on how to format the information. For example, the hypertext markup language (HTML) is used for presenting information on Internet web sites.

Information displays with their own illumination source often use a significant fraction of the available power for portable computing and/or communications devices. For example, PDAs and cell phones incorporate a display used for presenting both text and images. The display can be a significant drain on the power supply of the device and the power supply must be recharged at frequent intervals, limiting the available time that the device is usable between charges. This is inconvenient and reduces the usefulness of the device.

There is a need therefore for an improved method for reducing the power used by the display in a portable electronic device.

SUMMARY OF THE INVENTION

The need is met according to the present invention by providing a method and system for reducing the power used by a display device having light emitting pixels, including the steps of: receiving formatted information for presentation on the display device; modifying the format of the formatted information to reduce the number and/or intensity of bright pixels in a display of the formatted information; rendering the modified formatted information; and displaying the rendered modified formatted information on the display device.

ADVANTAGES

The present invention has the advantage that it reduces the power used by an emissive information display. The method can be simply and economically implemented by software in a display device having a controller or processor for rendering images to be displayed and is widely applicable to a variety of format standards.

DETAILED DESCRIPTION OF THE INVENTION

The present invention employs information format pre-processing for emissive displays. As used herein, "emissive display" refers to a display wherein each pixel is a light source as opposed to a light modulator, such as an organic light emitting diode (OLED) display. The pre-processing modifies the information format to reduce the number of bright pixels in the display. The pre-processing does not change the information content but does change the appearance of the information that is displayed.

Figure 1:
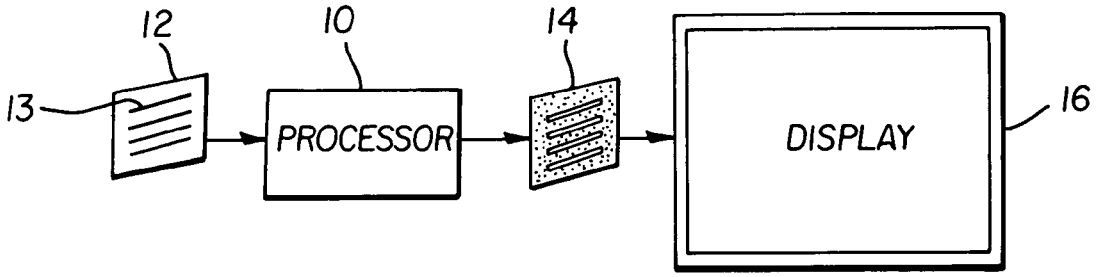
FIG. 1 is a schematic block diagram illustrating a display according to the present invention.
Figure 2:
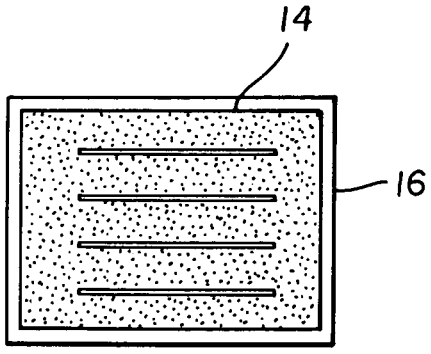
FIG. 2 is a schematic diagram illustrating a modified information format according to the present invention.

Referring to FIG. 1, a pre-processor 10 receives formatted information 12 to be displayed (represented by lines 13) and modifies the format of the information to contain fewer bright pixels. The modified information 14 is supplied to an emissive display 16 that displays the information in the modified format as shown in FIG. 2. In this example the format has been modified to produce light lines on a dark background, thereby utilizing fewer bright pixels in the display.

Figure 3:
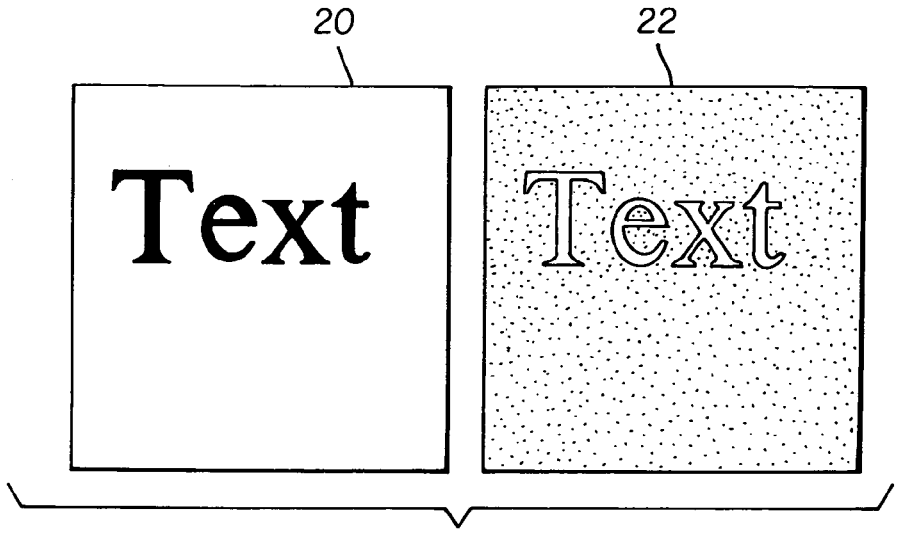
FIG. 3 is a schematic diagram illustrating a modification of text by changing dark text on a light background to light text on a dark background.

Referring to FIG. 3, original textual information content 20 is shown together with the same information content in a modified format 22. It can be seen from FIG. 3 that more pixels are dark in the modified format 22 than in the original format 20. Hence, displaying the modified format 22 will require less power than displaying the original format 20 since displaying a dark pixel on an emissive display requires less power than displaying a bright pixel.

Most information content is formatted using a markup language, containing specific markup tags. These tags are placed within the information content to define the appearance or format of the displayed information content. By modifying the tags or parameters associated with the tags, the information content will be rendered in a different format. For example, the hypertext markup language (html) uses a '<U>' string to indicate underline, and '<B>' string to indicate bold while attributes associated with tables or text (such as BGCOLOR) modify the color or brightness of the background or text.

Any modification that reduces the number of bright pixels will reduce the power usage in an emissive display. For example, the brightness of the background or text may be reduced. Using a light text on a dark background requires less power than the reverse. Likewise, bold text (if in a bright format) will require more power than normal text. The thickness of the text can be modified, for example by changing bright bold text on a dark background to normal text, or by changing dark normal text on a light background to bold text. Similarly, reducing the number of bright pixel elements in a graphic element or image can reduce the total power used by the display. This can be accomplished, for example, by setting all of the pixels below a certain threshold to black, reducing highlights in the graphic or image, or by scaling all of the pixels by a certain percentage thereby making the entire graphic less bright. Alternatively, graphic elements may be eliminated entirely and replaced with a black background. A less drastic alternative is to binarize the image or graphic element by setting every pixel in the image to either one of two values, a darker or a lighter value, depending on whether they are below or above a predetermined or pre-selected threshold. The values and threshold are chosen so that the average brightness of the image or graphic is reduced. The two values may, but need not necessarily, be black and white. The darker or more efficient the two binary values are, the greater the power savings. The threshold value should be set so as to maximize the number of pixels set to the darker or more efficient value. The information necessary to set the thresholds can be obtained from a histogram of the brightness code values of a particular image to be displayed, or from the histograms of a selection of representative images. This binarizing technique can also be applied to text and background to achieve power savings.

The degree to which the formatting is modified may be controlled by a viewer. For example, a viewer might enable only text and background color changes, modify a threshold for binarization or the binarized values or, alternatively, eliminate all graphic displays. This control can be managed by setting preferences used by a format modification program in the processor 10.

Since emissive displays may be less efficient in producing certain colors than others, it is also possible to reduce the power usage by using the more efficient colors in preference to the less efficient colors. If, for example, the green pixels are more efficient than red, replacing red with green as a preferred color in text will reduce the power use of the display. The color of the text and the background can also be reversed to save power if the background color is of the same brightness, but less efficient.

Figure 4:
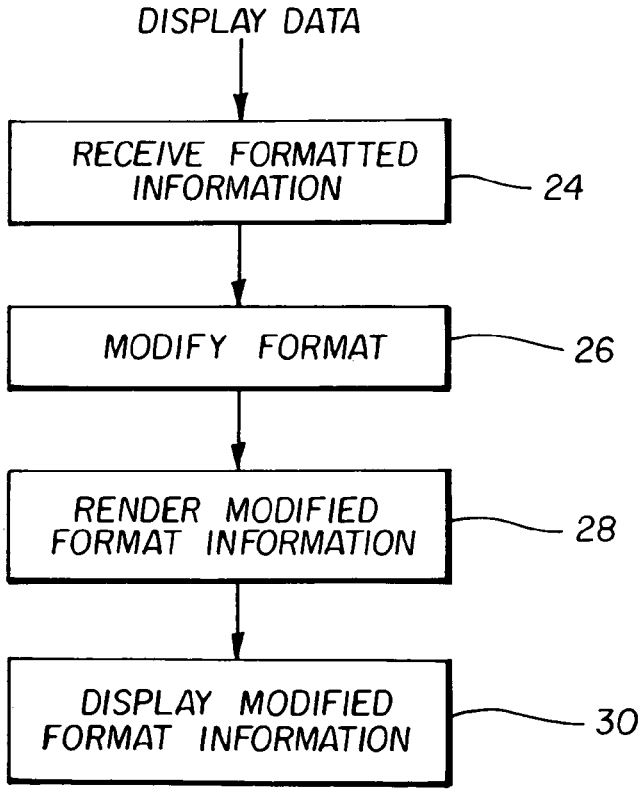
FIG. 4 is a flow chart showing the display method of the present invention.

In operation, the system and method works as follows. Referring to FIG. 4, the processor 10 receives 24 formatted information to display on a device. The processor 10 then modifies 26 the format of the information by analyzing the format tags in the formatted information and replacing the tags that will result in more power usage by the display with tags that will result in less power usage. The format modification can be done with a software program that reads the file of formatted information, identifies the tags and attributes associated with significant power use, and replaces them with pre-specified alternatives. Complementary attributes are maintained where necessary. For example, if a background is set to black, the text will not be set to the same color but is set to an energy efficient color instead. Likewise, any graphic elements or images can be processed to reduce the number of bright pixels in the displayed information. The modified information is then rendered 28 into code values representing the brightness of pixel elements in the display and displayed 30 on the display 16.

The invention has been described in detail with particular reference to certain preferred embodiments thereof, but it will be understood that variations and modifications can be effected within the spirit and scope of the invention.

PARTS LIST

10 processor
12 formatted information
13 lines
14 modified formatted information
16 display
20 formatted text line
22 modified formatted text
24 receive formatted information step
26 modify format step
28 render step
30 display step

What is claimed is:

1. A method for reducing the power used by a display device having light emitting pixels, comprising the steps of:

a) receiving formatted information for presentation on the display device, the formatted information being defined by a markup language having tags and parameters associated with the tags;

b) modifying the tags and/or the parameters associated with the tags of the formatted information to reduce the number and/or intensity of bright pixels in a display of the formatted information to produce modified formatted information;

c) rendering the modified formatted information; and d) displaying the rendered modified formatted information on the display device.

2. The method claimed in claim 1, wherein the display device is a portable emissive flat-panel display.

3. The method claimed in claim 1, wherein the display device is an OLED display device.

4. The method claimed in claim 1, wherein the information includes text formatted with characters presented on a background.

5. The method claimed in claim 4, wherein the information includes dark text on a light background and the format modification is the reversal of the brightness of the text and the background.

6. The method claimed in claim 4, wherein the modification is the reversal of the color of the text and the background.

7. The method claimed in claim 4, wherein the modification includes modifying the brightness of the text background.

8. The method claimed in claim 4, wherein the modification includes modifying the brightness of the text.

9. The method claimed in claim 4, wherein the display is a color display in which the display of some colors consumes less power than the display of other colors, and the modification includes modifying the color of the text background.

10. The method claimed in claim 9, wherein the modification is the reversal of the color of the text and the background.

11. The method claimed in claim 4, wherein the display is a color display wherein the display of some colors consumes less power than the display of other colors, and the modification includes modifying the color of the text.

12. The method claimed in claim 4, wherein the modification includes modifying the thickness of the text characters.

13. The method claimed in claim 12, wherein the modification includes changing light bold text on a dark background to normal text.

14. The method claimed in claim 12, wherein the modification includes changing dark normal text on a light background to bold text.

15. The method claimed in claim 1, wherein the information includes one or more graphic elements.

16. The method claimed in claim 15, wherein the modification includes modifying the brightness of the one or more of the graphic elements.

17. The method claimed in claim 15, wherein the display is a color display wherein the display of some colors consumes less power than the display of other colors, and the modification includes modifying the color of the one or more graphics.

18. The method claimed in claim 15, wherein the modification includes binarizing the one or more graphic elements.

19. The method claimed in claim 15, wherein the modification includes removing one or more of the graphic elements.

20. The method claimed in claim 1, wherein the modification is user selectable.

21. The method claimed in claim 4, wherein the modification includes binarizing the text characters and background.

22. The method claimed in claim 1 wherein the information format is described in hypertext markup language (html).

23. A display system, comprising:

a) a display device having light emitting pixels;

b) a source of formatted information for presentation on the display device, the formatted information being defined by a markup language having tags and parameters associated with the tags;

c) means for modifying the tags and/or the parameters associated with the tags of the formatted information to reduce the number and/or intensity of bright pixels in a display of the formatted information to produce modified formatted information; and d) means for rendering the modified formatted information for display on the display device.

24. The display system claimed in claim 23, wherein the display device is a portable emissive flat-panel display.

25. The display system claimed in claim 23, wherein the display device is an OLED display device.

26. The display system claimed in claim 23, wherein the information includes text formatted with characters presented on a background.

27. The display system claimed in claim 26, wherein the information includes dark text on a light background and the modification is the reversal of the brightness of the text and the background.

28. The display system claimed in claim 26, wherein the modification is the reversal of the color of the text and the background.

29. The display system claimed in claim 26, wherein the modification includes modifying the brightness of the text background.

30. The display system claimed in claim 26, wherein the modification includes modifying the brightness of the text.

31. The display system claimed in claim 26, wherein the display is a color display wherein the display of some colors consumes less power than the display of other colors, and the modification includes modifying the color of the text background.

32. The display system claimed in claim 31, wherein the modification is the reversal of the color of the text and the background.

33. The display system claimed in claim 26, wherein the display is a color display in which the display of some colors consumes less power than the display of other colors, and the modification includes modifying the color of the text.

34. The display system claimed in claim 26, wherein the modification includes modifying the thickness of the text characters.

35. The display system claimed in claim 34, wherein the modification includes changing light bold text on a dark background to normal text.

36. The display system claimed in claim 34, wherein the modification includes changing dark normal text on a light background to bold text.

37. The display system claimed in claim 23, wherein the information includes one or more graphic elements.

38. The display system claimed in claim 37, wherein the modification includes modifying the brightness of the one or more of the graphic elements.

39. The display system claimed in claim 37, wherein the display is a color display wherein the display of some colors consumes less power than the display of other colors, and the modification includes modifying the color of the one or more graphics.

40. The display system claimed in claim 37, wherein the modification includes binarizing the one or more graphic elements.

41. The display system claimed in claim 37, wherein the modification includes removing one or more of the graphic elements.

42. The display system claimed in claim 23, wherein the modification is user selectable.

43. The display system claimed in claim 23 wherein the information format is described in hypertext markup language (html).

44. The display system claimed in claim 26, wherein the modification includes binarizing the text characters and background.

* * * * *